US011951591B2

(12) United States Patent
Heo et al.

(10) Patent No.: US 11,951,591 B2
(45) Date of Patent: Apr. 9, 2024

(54) POLISHING PAD, METHOD FOR PRODUCING THE SAME AND METHOD OF FABRICATING SEMICONDUCTOR DEVICE USING THE SAME

(71) Applicant: SK enpulse Co., Ltd., Gyeonggi-do (KR)

(72) Inventors: Hye Young Heo, Gyeonggi-do (KR); Jang Won Seo, Seoul (KR); Jae In Ahn, Gyeonggi-do (KR); Jong Wook Yun, Seoul (KR)

(73) Assignee: SK ENPULSE CO., LTD., Gyeonggi-Do (KR)

( * ) Notice: Subject to any disclaimer, the term of this patent is extended or adjusted under 35 U.S.C. 154(b) by 56 days.

(21) Appl. No.: 17/520,206

(22) Filed: Nov. 5, 2021

(65) Prior Publication Data

US 2022/0143778 A1 May 12, 2022

(30) Foreign Application Priority Data

Nov. 6, 2020 (KR) ..... 10-2020-0147984
Nov. 6, 2020 (KR) ..... 10-2020-0147994

(51) Int. Cl.

*B24B 37/26* (2012.01)
*B24B 37/015* (2012.01)
*B24B 37/20* (2012.01)
*B24B 37/22* (2012.01)

(52) U.S. Cl.

CPC ..... *B24B 37/26* (2013.01); *B24B 37/015* (2013.01); *B24B 37/205* (2013.01); *B24B 37/22* (2013.01)

(58) Field of Classification Search

CPC ..... B24B 37/26; B24B 37/22
USPC ..... 51/298
See application file for complete search history.

(56) References Cited

U.S. PATENT DOCUMENTS

2017/0225291 A1* 8/2017 Takachi ..... B29C 39/02

FOREIGN PATENT DOCUMENTS

| | | | | | |
|---|---|---|---|---|---|
| CN | 108673332 | A | | 10/2018 | |
| CN | 110385641 | A | | 10/2019 | |
| JP | 2004-296591 | A | | 10/2004 | |
| JP | 2013-078839 | A | | 5/2013 | |
| JP | 2013078839 | A | * | 5/2013 | ..... B24B 37/24 |
| KR | 10-2007-0034640 | A | | 3/2007 | |

(Continued)

OTHER PUBLICATIONS

Office Action issued by the Korean Intellectual Property Office dated Apr. 1, 2022.

(Continued)

*Primary Examiner* — James E McDonough
(74) *Attorney, Agent, or Firm* — IP & T GROUP LLP

(57) ABSTRACT

The present disclosure provides a polishing pad, which may maintain polishing performances required for a polishing process, such as a removal rate and a polishing profile, minimize defects that may occur on a wafer during the polishing process, and polish layers of different materials so as to have the same level of flatness even when the layers are polished at the same time, and a method for producing the polishing pad. In addition, according to the present disclosure, it is possible to determine a polishing pad, which shows an optimal removal rate selectivity along with excellent performance in a CMP process, through the physical property values of the polishing pad without a direct polishing test.

10 Claims, 2 Drawing Sheets

(56) References Cited

FOREIGN PATENT DOCUMENTS

| | | | |
|---|---|---|---|
| KR | 10-2010-0084351 | A | 7/2010 |
| KR | 10-2013-0035225 | A | 4/2013 |
| TW | 201323466 | A1 | 6/2013 |
| WO | 2004/010487 | A1 | 1/2004 |

OTHER PUBLICATIONS

Office Action issued by the Korean Intellectual Property Office dated Mar. 31, 2022.
Office Action for the Japanese Patent Application No. 2021-181530 issued by the Japanese Patent Office dated Oct. 25, 2022.
Office Action for the Taiwanese Patent Application No. 110141284 issued by the Taiwanese Patent Office dated Jun. 23, 2022.
First Office Action on the Chinese Patent Application No. 202111303514.0 issued by the Chinese Patent Office dated Aug. 29, 2023.

* cited by examiner

[FIG. 1]
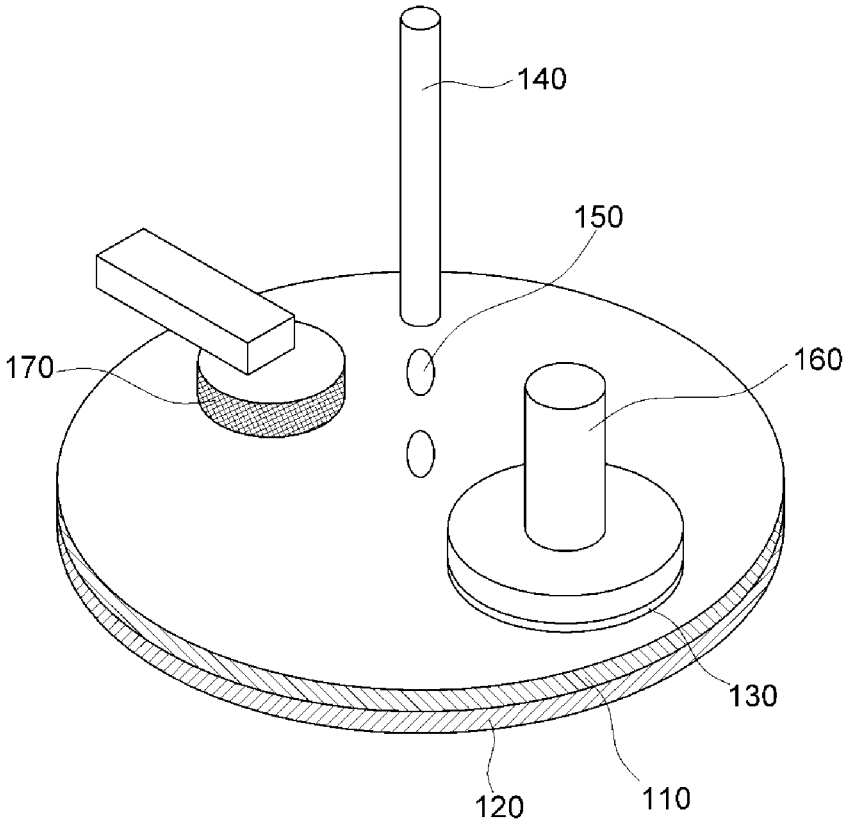

[FIG. 2]
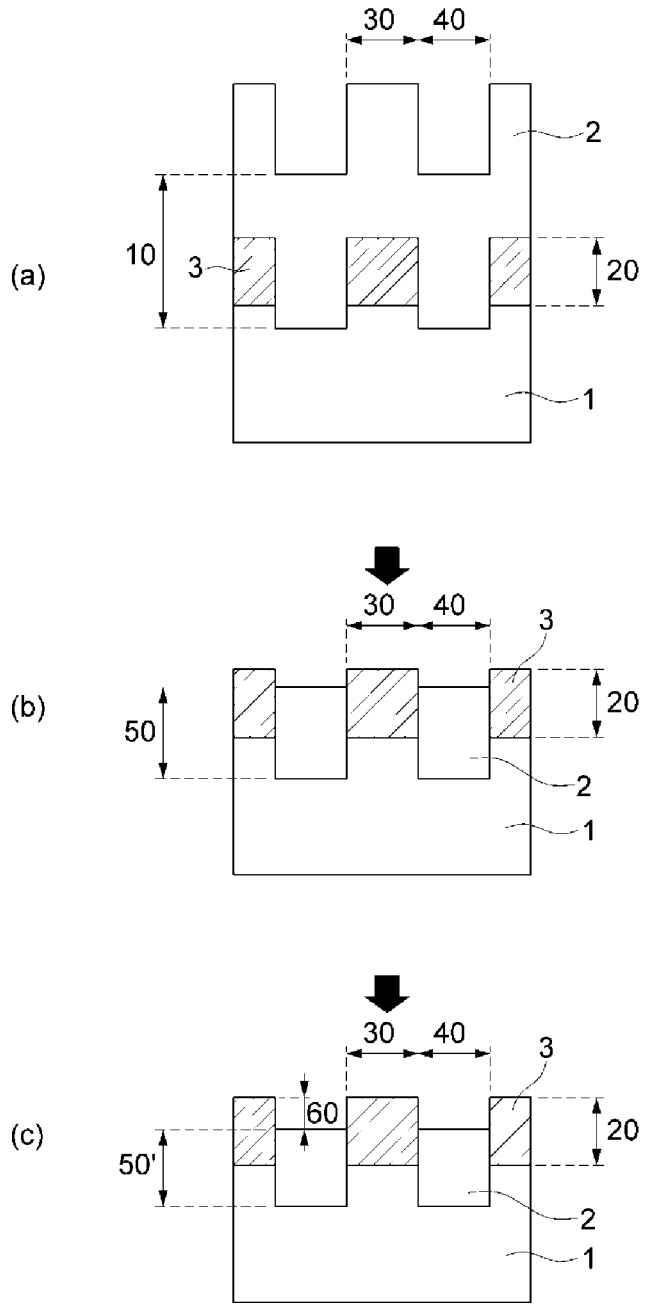

POLISHING PAD, METHOD FOR PRODUCING THE SAME AND METHOD OF FABRICATING SEMICONDUCTOR DEVICE USING THE SAME

CROSS-REFERENCE TO RELATED APPLICATION(S)

This application claims priority to Korean Patent Application No. 10-2020-0147994, filed on Nov. 6, 2020 and No. 10-2020-0147984, filed on Nov. 6, 2020, the disclosure of which is incorporated herein by reference in its entirety.

FIELD OF THE INVENTION

The present disclosure relates to a polishing pad for use in a chemical mechanical planarization (CMP) process, a method for producing the same, and a method of fabricating a semiconductor device using the same.

DESCRIPTION OF THE RELATED ART

Among semiconductor fabrication processes, a chemical mechanical planarization (CMP) process is a process that mechanically planarizes an uneven surface of a wafer by allowing a platen and a head to rotate relative to each other while subjecting the wafer surface to a chemical reaction by the supply of a slurry, in a state in which the wafer is attached to the head and brought into contact with the surface of a polishing pad formed on the platen.

In general, when a chemical mechanical polishing (CMP) process for forming a device isolation layer for a semiconductor device is performed, a ceria-based high selectivity slurry, which shows a great difference in removal rate between an oxide layer and a pad nitride layer, is used in order to increase the removal rate selectivity between the oxide layer and the pad nitride layer. However, when a ceria-based abrasive is used, problems arise in that a precipitation phenomenon occurs due to agglomeration between particles, and in order to prevent this phenomenon, a slurry precipitation prevention device capable of preventing precipitation should be used instead of the existing equipment.

In addition, when a ceria-based abrasive is used, a compound that increases the removal rate selectivity between an oxide layer and a pad nitride layer is added, and in this case, problems arise in that a device for supplying a multi-component slurry is required and the compound also affects the dispersibility between the ceria abrasive particles, thus reducing the life of the slurry.

In order to solve these problems, it has been proposed to add a new device for mixing the ceria abrasive and the additional compound at the end of the slurry supply device, but even when this device is added, a problem arises in that it is difficult to accurately control or maintain the mixing ratio between the abrasive and the additional compound.

When a polishing process is performed using a ceria-based abrasive, the time required for the polishing process increases because the removal rate of an oxide layer is lower than when a silica-based slurry is used. For this reason, a method has been proposed in which a silica-based slurry is used in a first process for polishing only an oxide layer and a ceria-based abrasive is used in a second process for polishing the oxide layer and a pad nitride layer at the same time.

However, this method has problems in that defects such as agglomeration are more likely to occur due to the difference in basic characteristics (such as pH) between the silica-based slurry and the ceria-based abrasive, and in that, since the polishing processes should be performed using different heads in different platens, the processes are complicated and two systems should be used.

As a result, there is a problem in that it is not easy to control the selectivity depending on the type of abrasive in the slurry. In order to solve this problem, it is necessary to develop a polishing pad capable of exhibiting a high removal rate selectivity without being affected by the abrasive contained in the slurry.

SUMMARY OF THE INVENTION

An object of the present disclosure is to provide a polishing pad and a method for producing the same.

Another object of the present disclosure is to provide a polishing pad, which is capable of maintaining polishing performances required for a polishing process, such as a removal rate and a polishing profile, and minimizing defects that may occur on a wafer during the polishing process, and polishing layers of different materials so as to have the same level of flatness even when the layers are polished at the same time, and a method for producing the same.

Still another object of the present disclosure is to determine a polishing pad, which shows an optimal removal rate selectivity along with excellent performance in a CMP process, through the physical property values of the polishing pad without a direct polishing test, and to provide a method for producing the polishing pad.

Yet another object of the present disclosure is to provide a method of fabricating a semiconductor device using a polishing pad.

To achieve the above objects, a polishing pad according to one embodiment of the present disclosure may include a polishing layer having a value of 0.6 to 1.2 as calculated by the following Equation 1:

$$\frac{0.1H + 0.3M + 0.6E}{100} \quad \text{[Equation 1]}$$

wherein:

H is the surface hardness (shore D) of the polishing surface of the polishing layer;

M is the elastic modulus ($N/mm^2$) of the polishing layer; and

E is the elongation (%) of the polishing layer.

A method for producing a polishing pad according to another embodiment of the present disclosure may include steps of: i) preparing a prepolymer composition; ii) preparing a composition for producing a polishing layer containing the prepolymer composition, a foaming agent and a curing agent; and iii) producing a polishing layer by curing the composition for producing a polishing layer, wherein the polishing layer has a value of 0.6 to 1.2 as calculated by the following Equation 1:

$$\frac{0.1H + 0.3M + 0.6E}{100} \quad \text{[Equation 1]}$$

wherein:

H is the surface hardness (shore D) of the polishing surface of the polishing layer;

M is the elastic modulus ($N/mm^2$) of the polishing layer; and

E is the elongation (%) of the polishing layer.

A method for fabricating a semiconductor device according to still another embodiment of the present disclosure may include steps of: 1) providing a polishing pad including a polishing layer; 2) polishing a semiconductor substrate while allowing the semiconductor substrate and the polishing layer to rotate relative to each other so that a polishing-target surface of the semiconductor substrate is in contact with the polishing surface of the polishing layer, wherein the polishing layer has a value of 0.6 to 1.2 as calculated by the following Equation 1:

$$\frac{0.1H + 0.3M + 0.6E}{100} \quad \text{[Equation 1]}$$

wherein:

H is the surface hardness (shore D) of the polishing surface of the polishing layer;

M is the elastic modulus ($N/mm^2$) of the polishing layer; and

E is the elongation (%) of the polishing layer.

A polishing pad according to the present disclosure may maintain polishing performances required for a polishing process, such as a removal rate and a polishing profile, minimize defects that may occur on a wafer during the polishing process, and polish layers of different materials so as to have the same level of flatness even when the layers are polished at the same time. In addition, according to the present disclosure, it is possible to determine a polishing pad, which shows an optimal removal rate selectivity along with excellent performance in a CMP process, through the physical property values of the polishing pad without a direct polishing test.

In addition, the present disclosure may provide a method of fabricating a semiconductor device using a polishing pad.

BRIEF DESCRIPTION OF THE DRAWINGS

FIG. 1 schematically illustrates a process for fabricating a semiconductor device according to one embodiment of the present disclosure.

FIG. 2 schematically illustrates a process for measuring dishing according to one embodiment of the present disclosure.

DESCRIPTION OF SPECIFIC EMBODIMENTS

Hereinafter, embodiments of the present disclosure will be described in detail so that those skilled in the art can easily carry out the present disclosure. However, the present disclosure may be embodied in a variety of different forms and is not limited to the embodiments described herein.

All numbers expressing quantities of components, properties such as molecular weights and reaction conditions, and so forth used in the present disclosure are to be understood as being modified in all instances by the term "about".

Unless otherwise stated herein, all percentages, parts, ratios, etc. are by weight.

In the present disclosure, it is understood that when any part is referred to "including" or "containing" any component, it may further include other components, rather than excluding other components, unless otherwise stated.

As used herein, "a plurality" refers to more than one.

In the present disclosure, the term "oxide layer" may refer to a silicon oxide layer, and the term "nitride layer" may refer to a silicon nitride layer, but the meanings of the terms are not limited to the above examples, and the terms may mean target oxide or nitride layers that may be used in the fabrication of a semiconductor substrate.

A polishing pad according to one embodiment of the present disclosure may include a polishing layer having a value of 0.6 to 1.2 as calculated by the following Equation 1:

$$\frac{0.1H + 0.3M + 0.6E}{100} \quad \text{[Equation 1]}$$

wherein:

H is the surface hardness (shore D) of the polishing surface of the polishing layer;

M is the elastic modulus ($N/mm^2$) of the polishing layer; and

E is the elongation (%) of the polishing layer.

In addition, the polishing layer may have a value of 0.6 to 1.2 as calculated by the following Equation 2:

$$\frac{0.1H + 0.2M + 0.7E}{100} \quad \text{[Equation 2]}$$

wherein H, M and E are as defined in Equation 1 above.

The polishing layer may include a cured product by curing a composition containing a urethane-based prepolymer, a curing agent and a foaming agent, and the urethane-based prepolymer may be produced by allowing an isocyanate to react with a polyol.

Depending on the type and content of a curing agent that may be included in the production of the polishing layer, the equivalents of curing reactive groups such as an amine group (—$NH_2$) and an alcohol group (—OH) in the curing agent and an isocyanate group (—NCO) in the prepolymer are determined, and depending on the molding temperature in a mold, the curing rate and the sequential order of the chemical reactions are determined.

The final urethane-based cured structure of the polishing pad is determined by these factors. The final urethane-based curing structure may lead to the physical/mechanical properties of the polishing layer, such as hardness, tensile strength, and elongation.

In particular, the polishing layer of the present disclosure may have a value of 0.6 to 1.2, 0.7 to 1.1, or 0.8 to 1, as calculated by Equation 1 above regarding the hardness, elastic modulus and elongation of the polishing layer, and may have a value of 0.6 to 1.2, 0.7 to 1.1, or 0.8 to 1, as calculated by Equation 2 above.

When the value calculated by Equation 1 and/or Equation 2 above are within the above range, it is possible to control particularly the removal rate selectivity among the polishing performances of a polishing target containing an oxide layer and a nitride layer.

In general, the removal rate selectivity of the nitride layer to the oxide layer should be controlled to minimize defects that may occur on the wafer, as well as to prevent the dishing phenomenon.

If the removal rate selectivity of the nitride layer to the oxide layer is low, a problem arises in that it is impossible to achieve uniform surface planarization, due to the occurrence of a dishing phenomenon in which the oxide layer is excessively removed due to the loss of the adjacent nitride layer pattern.

In addition, if the removal rate selectivity of the nitride layer to the oxide layer is high, the upper layer may be excessively removed, causing a recess, and an erosion phenomenon, in which a dielectric layer or a barrier layer collapses due to the physical action of the abrasive particles, may intensify.

That is, the polishing pad of the present disclosure is characterized in that the removal rate selectivity to the oxide layer and the nitride layer is controlled within a certain range, so that the polishing pad achieves surface planarization of a target layer in a semiconductor substrate.

Equations 1 and 2 above are derived by defining weights for hardness, elastic modulus and elongation and calculating values depending on the weights. Through the relationship between hardness, elastic modulus and elongation according to the above Equations, it is possible to control the oxide to nitride removal rate selectivity (Ox RR/Nt RR) of the polishing pad.

The polishing layer of the polishing pad includes a urethane-based prepolymer, and the cured structure of the urethane-based prepolymer may affect the physical/mechanical characteristics of the polishing layer, including hardness, elastic modulus, and elongation.

The physical/mechanical properties of the polishing layer correspond to factors that directly affect the removal rate when the polishing pad including the polishing layer is applied to a polishing process, and there may be a difference in the removal rate of a target layer due to differences in hardness, elastic modulus and elongation of the polishing layer.

When the removal rate is controlled, it is possible to prevent the occurrence of defects by finely controlling the removal rate of each target layer, as described above. That is, it is possible to prevent the occurrence of defects such as dishing, recess and erosion by controlling the removal rate. The target layers may be an oxide layer and a nitride layer, but are not limited thereto.

Among the physical/mechanical properties of the polishing layer, hardness, elastic modulus and elongation are important factors that affect the removal rates of the target layers. Only when the values of hardness, elastic modulus, and elongation are balanced to exhibit specific removal rates, the polishing layer may exhibit desired polishing performance.

Accordingly, in the present disclosure, as shown in Equation 1 and Equation 2 above, weights are given to hardness, elastic modulus and elongation and values thereof are specified. By doing so, it is possible to exhibit excellent polishing performance by controlling the removal rate selectivity of an oxide layer to a nitride layer.

In another embodiment, in order to use a polishing pad in a CMP process, a polishing test needs to be performed to verify that the removal rate selectivity is suitable for the process.

Specifically, it is necessary to check the removal rates of oxide and nitride layers in the CMP process, but the determination of the removal rates was possible only through values obtained through a direct polishing test.

However, in the case of the polishing pad of the present disclosure, an expected value of the removal rate selectivity between oxide and nitride may be obtained by determining the physical property values of surface hardness, elastic modulus and elongation of the polishing surface and substituting the determined values into Equations 1 and 2, and thus it is possible to use the polishing pad without a polishing test.

The polishing pad may have an oxide removal rate of 1,500 Å/min to 2,500 Å/min, 2,000 Å/min to 2,400 Å/min, or 2,100 Å/min to 2,400 Å/min, and may have a nitride removal rate of 35 Å/min to 100 Å/min, 40 Å/min to 90 Å/min, or 45 Å/min to 80 Å/min.

In addition, the polishing pad may have an oxide to nitride removal rate selectivity (Ox RR/Nt RR) of 25 to 40, 30 to 35, or 31 to 33.

In the case of the polishing pad of the present disclosure, the oxide removal rate and the nitride removal rate may be included within the above ranges, and the oxide to nitride removal rate selectivity (Ox RR/Nt RR) may be included within the above range. That is, the polishing pad of the present disclosure is characterized in that the oxide removal rate and the nitride removal rate are included within the above ranges, and at the same time, the oxide to nitride removal rate selectivity is included within the above range.

When the oxide and nitride removal rates and the oxide to nitride removal rate selectivity are included within the above ranges, the polishing performance of the polishing pad may be excellent, and it is possible to prevent the occurrence of defects, such as dishing, recess and erosion, by controlling the removal rates.

The removal rate selectivity is calculated by measuring the oxide and nitride removal rates. Specifically, the oxide removal rate is calculated based on the difference between before and after polishing by: using a 300-mm-diameter silicon wafer having a silicon oxide (SiOx) layer deposited thereon; polishing the silicon oxide layer under a polishing load of 1.4 psi for 60 seconds while introducing a ceria slurry onto the polishing surface at a rate of 190 ml/min and rotating a surface plate equipped with the polishing pad at a speed of 115 rpm; and then measuring the thickness of the silicon oxide layer.

The nitride removal rate is calculated based on the difference between before and after polishing by: using a 300-mm-diameter silicon wafer having a silicon nitride (SiN) layer deposited thereon; polishing the SiN layer under a polishing load of 1.4 psi for 60 seconds while introducing a ceria slurry onto the polishing surface at a rate of 190 ml/min and rotating a surface plate equipped with the polishing pad at a speed of 115 rpm; and then measuring the thickness of the SiN layer.

In addition to Equations 1 and 2 above, the polishing layer may have a value of 1 to 1.7 as calculated by the following Equation 3 regarding the relationship between the elastic modulus and elongation of the polishing layer:

$$\frac{0.8M + 0.2E}{100} \quad \text{[Equation 3]}$$

wherein:

M is the elastic modulus ($N/mm^2$) of the polishing layer; and

E is the elongation (%) of the polishing layer.

In addition, the polishing layer may have a value of 1 to 1.7 as calculated by the following Equation 4 regarding the relationship between the elastic modulus and surface hardness of the polishing layer:

$$\frac{0.9M + 0.1H}{100} \quad \text{[Equation 4]}$$

wherein:

M is the elastic modulus ($N/mm^2$) of the polishing layer; and

H is a surface hardness (shore D) of a polishing surface of the polishing layer.

Equations 1 and 2 above define weights for elastic modulus and elongation, and are used to identify an optimal combination between surface hardness, elastic modulus, and elongation.

Equations 3 and 4 define the combination of elastic modulus and elongation (Equation 3) or the combination of elastic modulus and surface hardness (Equation 4), and a polishing pad satisfying the range values determined by Equations 3 and 4 may have excellent polishing performance and may minimize the occurrence of defects, particularly dishing, on a wafer during a polishing process.

FIG. 2 shows a process for polishing a semiconductor substrate using a polishing pad and checking dishing that occurs during the polishing process.

Specifically, a polishing process was performed using a Si substrate 1 (which is a wafer having a diameter of 300 mm) having a nitride layer 3 and oxide layer 2 deposited on one surface thereof. Here, on the Si substrate, a pattern consisting of a line 30 and a space 40, each having a size of 100 μm, was formed.

In the polishing process, polishing was performed under a polishing load of 4.0 psi for 60 seconds while a ceria slurry was introduced into the polishing surface at a rate of 300 ml/min and a surface plate equipped with the polishing pad was rotated at a speed of 87 rpm. As a result of the polishing process, the height 50 of the oxide layer was 1,200 Å to 1,400 Å, and the height 20 of the nitride layer was 1,000 Å.

Thereafter, an additional polishing process was performed for 40 seconds under the same polishing conditions as above, and the degree of dishing 60 was measured.

The dishing value (A) is a measure of the distance from the uppermost portion of the nitride layer to the uppermost portion of the oxide layer, and may be controlled within an absolute range of 1 Å to 100 Å, 2 Å to 50 Å, or 3 Å to 40 Å, suggesting that the effect of suppressing defects is excellent.

That is, when a polishing process is performed using a conventional polishing pad in the same manner as shown in FIG. 2 and the degree of dishing is measured, the dishing value is more than 100 Å, which significantly differs from the dishing value measured when the polishing pad of the present disclosure is used.

In order for the polishing pad to polish layers of different materials to have the same level of flatness, it is a very important factor to control the mechanical properties of the polishing layer of the polishing pad. When the polishing pad satisfies a value of 1 to 1.7 as calculated by Equation 3 and/or Equation 4 above, the polishing performance of the polishing pad for a polishing target containing an oxide layer and a nitride layer can be realized at a desired level, particularly in terms of preventing dishing.

Equation 3 and/or Equation 4 define(s) parameters regarding the mechanical property values of the polishing pad itself, and when these parameters are satisfied, it is possible to maintain the polishing performances required for the polishing process, such as removal rate and a polishing profile, and it is possible to prevent dishing while minimizing defects that may occur on the wafer during the polishing process.

In addition, when a value calculated using Equation 3 and/or Equation 4 is included within the scope of the present disclosure as in Equation 1 and/or 2, where it is necessary to select a polishing pad depending on a target layer or a stop layer from among a plurality of polishing pads at the site where the polishing process is directly applied, it is possible to directly determine the performance of a polishing pad through the value calculated by Equations 3 and/or 4 regarding the physical property values of the polishing pad without a direct polishing test, and it is possible to select a polishing pad having an excellent effect of preventing the occurrence of defects.

Accordingly, where a polishing pad is to be applied at the site, it is possible to avoid the hassle of having to perform a performance check through a direct polishing test, and it is possible to easily select a polishing pad, which satisfies the value calculated by Equation 3 and/or Equation 4, based on the measured physical property values of the polishing pad. When this selected polishing pad is applied to a polishing process, it may exhibit excellent polishing performance and have an excellent effect of preventing defects, particularly dishing.

In another embodiment of the present disclosure, the surface hardness (shore D) of the polishing surface of the polishing layer of the polishing pad is 45 to 65, the elastic modulus of the polishing layer is 70 $N/mm^2$ to 200 $N/mm^2$, and the elongation of the polishing layer is 60% to 140%.

Specifically, the polishing surface of the polishing layer may have a surface hardness (shore D) of 45 to 65, 50 to 60, or 55 to 59, at 25° C.

The elastic modulus may be 70 to 200 $N/mm^2$, 100 $N/mm^2$ to 150 $N/mm^2$, or 105 $N/mm^2$ to 140 $N/mm^2$.

The elongation may be 70% to 120%, 75% to 100%, or 77% to 90%.

In another embodiment of the present disclosure, the polishing layer may include a polishing layer including a cured product formed from a composition containing a urethane-based prepolymer, a curing agent and a foaming agent.

Each of the components contained in the composition will now be described in detail.

The term "prepolymer" refers to a polymer with a relatively low molecular weight, the polymerization of which has been stopped in an intermediate step in the production of a cured product so as to facilitate molding. The prepolymer may be formed directly into a final cured product or may be formed into a final cured product after reaction with another polymerizable compound.

In one embodiment, the urethane-based prepolymer may be produced by allowing an isocyanate compound to react with a polyol.

The isocyanate compound that is used in the production of the urethane-based prepolymer may be one selected from the group consisting of an aromatic diisocyanate, an aliphatic diisocyanate, an alicyclic diisocyanate, and combinations thereof.

The isocyanate compound may include, for example, one selected from the group consisting of 2,4-toluene diisocyanate (2,4-TDI), 2,6-toluene diisocyanate (2,6-TDI) naphthalene-1,5-diisocyanate, p-phenylene diisocyanate, tolidine diisocyanate, 4,4'-diphenylmethane diisocyanate, hexamethylene diisocyanate, dicyclohexylmethane diisocyanate, isoporone diisocyanate, and combinations thereof.

The term "polyol" refers to a compound containing at least two hydroxyl groups (—OH) per molecule. The polyol may include, for example, one selected from the group consisting of a polyether polyol, a polyester polyol, a polycarbonate polyol, an acrylic polyol, and combinations thereof.

The polyol may include, for example, one selected from the group consisting of polytetramethylene ether glycol, polypropylene ether glycol, ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol, and combinations thereof.

The polyol may have a weight-average molecular weight (Mw) of about 100 g/mol to about 3,000 g/mol. For example, the polyol may have a weight-average average molecule (Mw) of about 100 g/mol to about 3,000 g/mol, for example, about 100 g/mol to about 2,000 g/mol, for example, about 100 g/mol to about 1,800 g/mol.

In one embodiment, the polyol may include a low-molecular-weight polyol having a weight average molecular weight (Mw) of about 100 g/mol to less than about 300 g/mol, and a high-molecular-weight polyol having a weight-average molecular weight (Mw) of about 300 g/mol to about 1,800 g/mol.

The urethane-based prepolymer may have a weight-average molecular weight (Mw) of about 500 g/mol to about 3,000 g/mol. The urethane-based prepolymer may have a weight-average molecular weight (Mw) of, for example, about 600 g/mol to about 2,000 g/mol, for example, about 800 g/mol to about 1,000 g/mol.

In one embodiment, the isocyanate compound for producing the urethane-based prepolymer may include an aromatic diisocyanate compound. For example, the aromatic diisocyanate compound may include, for example, 2,4-toluene diisocyanate (2,4-TDI) and 2,6-toluenediisocyanate (2,6-TDI). In addition, the polyol compound for producing the urethane-based prepolymer may include, for example, polytetramethylene ether glycol (PTMEG) and diethylene glycol (DEG).

In another embodiment, the isocyanate compound for producing the urethane-based prepolymer may include an aromatic diisocyanate compound and an alicyclic diisocyanate compound. For example, the aromatic diisocyanate compound may include 2,4-toluene diisocyanate (2,4-TDI) and 2,6-toluene diisocyanate (2,6-TDI), and the alicyclic diisocyanate compound may include dicyclohexylmethane-diisocyanate (H12MDI). In addition, the polyol compound for producing the urethane-based prepolymer may include, for example, polytetramethylene ether glycol (PTMEG) and diethylene glycol (DEG).

The urethane-based prepolymer may have an isocyanate end group content (NCO %) of about 5 wt % to about 11 wt %, for example, about 5 wt % to about 10 wt %, for example, about 5 wt % to about 8 wt %, for example, about 8 wt % to about 10 wt %. When the urethane-based prepolymer has NCO % within the above range, the polishing layer of the polishing pad may exhibit appropriate properties and maintain polishing performance required for the polishing process, such as removal rate and polishing profile, and it is possible to minimize defects that may occur on the wafer during the polishing process.

In addition, as the oxide to nitride removal rate selectivity (Ox RR/Nt RR) is controlled, it is possible to prevent dishing, recess and erosion phenomena, and to achieve wafer surface planarization.

The isocyanate end group content (NCO %) of the urethane-based prepolymer may be designed by comprehensively controlling the types and contents of the isocyanate compound and polyol compound for producing the urethane-based prepolymer, process conditions such as the temperature, pressure and time of the process for producing the urethane-based prepolymer, and the types and contents of additives that are used in the production of the urethane-based prepolymer.

The curing agent is a compound that chemically reacts with the urethane-based prepolymer to form a final cured structure in the polishing layer, and may include, for example, an amine compound or an alcohol compound. Specifically, the curing agent may include one selected from the group consisting of aromatic amines, aliphatic amines, aromatic alcohols, aliphatic alcohols, and combinations thereof.

For example, the curing agent may include one selected from the group consisting of 4,4'-methylenebis(2-chloroaniline (MOCA), diethyltoluenediamine (DETDA), diaminodiphenylmethane, dimethyl thio-toluene diamine (DMTDA), propanediol bis-p-aminobenzoate, methylene bis-methylanthranilate, diaminodiphenylsulfone, m-xylylenediamine, isophoronediamine, ethylenediamine, diethylenetriamine, triethylenetetramine, polypropylenediamine, polypropylenetriamine, bis(4-amino-3-chlorophenyl)methane, and combinations thereof.

The content of the curing agent may be about 20 parts by weight to about 30 parts by weight, for example, about 21 parts by weight to about 27 parts by weight, for example, about 20 parts by weight to about 26 parts by weight, based on 100 parts by weight of the urethane-based prepolymer. When the content of the curing agent satisfies the above range, it may more advantageously realize the desired performance of the polishing pad.

The foaming agent is a component for forming a pore structure in the polishing layer, and may include one selected from the group consisting of a solid foaming agent, a gaseous foaming agent, a liquid foaming agent, and combinations thereof. In one embodiment, the foaming agent may include a solid foaming agent, a gaseous foaming agent, or a combination thereof.

The average particle diameter of the solid foaming agent may be about 5 μm to about 200 μm, for example, about 20 μm to about 50 μm, for example, about 21 μm to about 50 μm, for example, about 25 μm to about 45 μm. When the solid foaming agent is thermally expanded particles as described below, the average particle diameter of the solid foaming agent means the average particle diameter of the thermally expanded particles themselves, and when the solid foaming agent is unexpanded particles as described below, the average particle diameter of the solid foaming agent may mean the average particle diameter of the solid foaming agent after being expanded by heat or pressure.

The solid foaming agent may include expandable particles. The expandable particles are particles having a property that can be expanded by heat or pressure, and the size thereof in the final polishing layer may be determined by the heat or pressure applied during the process of producing the polishing layer. The expandable particles may include thermally expanded particles, unexpanded particles, or a combination thereof. The thermally expanded particles are particles pre-expanded by heat, and refer to particles having little or no size change caused by the heat or pressure applied during the process of producing the polishing layer. The unexpanded particles are non-pre-expanded particles, and refer to particles whose final size is determined by expansion caused by the heat or pressure applied during the process of producing the polishing layer.

The expandable particles may include: an outer shell made of a resin material; and an expansion-inducing component enclosed by and present in the outer shell.

For example, the outer shell may include a thermoplastic resin, and the thermoplastic resin may be at least one selected form the group consisting of a vinylidene chloride-based copolymer, an acrylonitrile-based copolymer, a methacrylonitrile-based copolymer, and an acrylic copolymer.

The expansion-inducing component may include one selected from the group consisting of a hydrocarbon compound, a chlorofluoro compound, a tetraalkylsilane compound, and combinations thereof.

Specifically, the hydrocarbon compound may include one selected from the group consisting of ethane, ethylene, propane, propene, n-butane, isobutane, n-butene, isobutene, n-pentane, isopentane, neopentane, n-hexane, heptane, petroleum ether, and combinations thereof.

The chlorofluoro compound may include one selected from the group consisting of trichlorofluoromethane ($CCl_3F$), dichlorodifluoromethane ($CCl_2F_2$), chlorotrifluoromethane ($CClF_3$), tetrafluoroethylene ($CClF_2$—$CClF_2$), and combinations thereof.

The tetraalkylsilane compound may include one selected from the group consisting of tetramethylsilane, trimethylethylsilane, trimethylisopropylsilane, trimethyl-n-propylsilane, and combinations thereof.

The solid foaming agent may optionally include particles treated with an inorganic component. For example, the solid foaming agent may include expandable particles treated with an inorganic component. In one embodiment, the solid foaming agent may include expandable particles treated with silica ($SiO_2$) particles. The treatment of the solid foaming agent with the inorganic component may prevent aggregation between a plurality of particles. The chemical, electrical, and/or physical properties of the surface of the inorganic component-treated solid foaming agent may differ from those of a solid foaming agent not treated with the inorganic component.

The content of the solid foaming agent may be about 0.5 parts by weight to about 10 parts by weight, for example, about 1 part by weight to about 3 parts by weight, for example, about 1.3 parts by weight to about 2.7 parts by weight, for example, about 1.3 parts by weight to about 2.6 parts by weight, based on 100 parts by weight of the urethane-based prepolymer.

The type and content of the solid foaming agent may be designed depending on the desired pore structure and physical properties of the polishing layer.

The gaseous foaming agent may include an inert gas. The gaseous foaming agent may be used as a pore-forming element which is added during a reaction between the urethane-based prepolymer and the curing agent.

The type of inert gas is not particularly limited as long as it does not participate in the reaction between the urethane-based prepolymer and the curing agent. For example, the inert gas may include one selected from the group consisting of nitrogen gas ($N_2$), argon gas (Ar), helium gas (He), and combinations thereof. Specifically, the inert gas may include nitrogen gas ($N_2$) or argon gas (Ar).

The type and content of the gaseous foaming agent may be designed depending on the desired pore structure and physical properties of the polishing layer.

In one embodiment, the foaming agent may include a solid foaming agent. For example, the foaming agent may consist only of a solid foaming agent.

The solid foaming agent may include expandable particles, and the expandable particles may include thermally expanded particles. For example, the solid foaming agent may consist only of thermally expanded particles. When the solid foaming agent consists only of the thermally expanded particles without including the unexpanded particles, the variability of the pore structure may be lowered, but the possibility of predicting the pore structure may increase, and thus the solid foaming agent may advantageously achieve homogeneous pore properties throughout the polishing layer.

In one embodiment, the thermally expanded particles may be particles having an average particle diameter of about 5 μm to about 200 μm. The average particle diameter of the thermally expanded particles may be about 5 μm to about 100 μm, for example, about 10 μm to about 80 μm, for example, about 20 μm to about 70 μm, for example, about 20 μm to about 50 μm, for example, about 30 μm to about 70 μm, for example, about 25 μm to 45 μm, for example, about 40 μm to about 70 μm, for example, about 40 μm to about 60 μm. The average particle diameter is defined as the D50 of the thermally expanded particles.

In one embodiment, the density of the thermally expanded particles may be about 30 $kg/m^3$ to about 80 $kg/m^3$, for example, about 35 $kg/m^3$ to about 80 $kg/m^3$, for example, about 35 $kg/m^3$ to about 75 $kg/m^3$, for example about 38 $kg/m^3$ to about 72 $kg/m^3$, for example, about 40 $kg/m^3$ to about 75 $kg/m^3$, for example, 40 $kg/m^3$ to about 72 $kg/m^3$.

In one embodiment, the foaming agent may include a gaseous foaming agent. For example, the foaming agent may include a solid foaming agent and a gaseous foaming agent. Details regarding the solid foaming agent are as described above.

The gaseous foaming agent may include nitrogen gas.

The gaseous foaming agent may be injected through a predetermined injection line in the process in which the urethane-based prepolymer, the solid foaming agent and the curing agent are mixed together. The injection rate of the gaseous foaming agent may be about 0.8 L/min to about 2.0 L/min, for example, about 0.8 L/min to about 1.8 L/min, for example, about 0.8 L/min to about 1.7 L/min, for example, about 1.0 L/min to about 2.0 L/min, for example, about 1.0 L/min to about 1.8 L/min, for example, about 1.0 L/min to about 1.7 L/min.

The composition for producing the polishing layer and the window may further contain other additives such as a surfactant and a reaction rate controller. The names such as "surfactant" and "reaction rate controller" are arbitrary names given based on the main function of the corresponding substance, and each corresponding substance does not necessarily perform only a function limited to the function indicated by the corresponding name.

The surfactant is not particularly limited as long as it is a material that serves to prevent aggregation or overlapping of pores. For example, the surfactant may include a silicone-based surfactant.

The surfactant may be used in an amount of about 0.2 parts by weight to about 2 parts by weight based on 100 parts by weight of the urethane-based prepolymer. Specifically, the surfactant may be contained in an amount of about 0.2 parts by weight to about 1.9 parts by weight, for example, about 0.2 parts by weight to about 1.8 parts by weight, for example, about 0.2 parts by weight to about 1.7 parts by weight, for example, about 0.2 parts by weight to about 1.6 parts by weight, for example, about 0.2 parts by weight to about 1.5 parts by weight, for example, about 0.5 parts by weight to 1.5 parts by weight, based on 100 parts by weight of the urethane-based prepolymer. When the surfactant is contained in an amount within the above range, pores derived from the gaseous foaming agent may be stably formed and maintained in the mold.

The reaction rate controller serves to accelerate or retard the reaction, and depending on the purpose thereof, may include a reaction accelerator, a reaction retarder, or both. The reaction rate controller may include a reaction accelerator. For example, the reaction accelerator may be at least one reaction accelerator selected from the group consisting of a tertiary amine-based compound and an organometallic compound.

Specifically, the reaction rate controller may include at least one selected from the group consisting of triethylenediamine, dimethylethanolamine, tetramethylbutanediamine, 2-methyl-triethylenediamine, dimethylcyclohexylamine, triethylamine, triisopropanolamine, 1,4-diazabicyclo(2,2,2)octane, bis(2-methylaminoethyl)ether, trimethylaminoethylethanolamine, N,N,N,N,N"-pentamethyldiethylenetriamine, dimethylaminoethylamine, dimethylaminopropylamine, benzyldimethylamine, N-ethylmorpholine, N,N-dimethylaminoethylmorpholine, N,N-dimethylcyclohexylamine, 2-methyl-2-azanorbonene, dibutyltin dilaurate, stannous octoate, dibutyltin diacetate, dioctyltin diacetate, dibutyltin maleate, dibutyltin di-2-ethylhexanoate, and dibutyltin dimercaptide. Specifically, the reaction rate controller may include at least one selected from the group consisting of benzyldimethylamine, N,N-dimethylcyclohexylamine, and triethylamine.

The reaction rate controller may be used in an amount of about 0.05 parts by weight to about 2 parts by weight based on 100 parts by weight of the urethane-based prepolymer. Specifically, the reaction rate controller may be used in an amount of about 0.05 parts by weight to about 1.8 parts by weight, for example, about 0.05 parts by weight to about 1.7 parts by weight, for example, about 0.05 parts by weight to about 1.6 parts by weight, for example, about 0.1 parts by weight to about 1.5 parts by weight. parts, for example, about 0.1 parts by weight to about 0.3 parts by weight, for example, about 0.2 parts by weight to about 1.8 parts by weight, for example, about 0.2 parts by weight to about 1.7 parts by weight, for example, about 0.2 parts by weight to about 1.6 parts by weight, for example, about 0.2 parts by weight to about 1.5 parts by weight, for example, about 0.5 parts by weight to about 1 part by weight, based on 100 parts by weight of the urethane-based prepolymer. When the reaction rate controller is used in an amount within the above-described content range, it is possible to appropriately control the curing reaction rate of the preliminary composition to form a polishing layer having pores of a desired size and having a desired hardness.

When the polishing pad includes a cushion layer, the cushion layer may serve to absorb and disperse an external impact applied to the polishing layer while supporting the polishing layer, thereby minimizing the occurrence of damage to the polishing target and defects thereon during the polishing process performed using the polishing pad.

The cushion layer may include, but is not limited to, non-woven fabric or suede.

In one embodiment, the cushion layer may be a resin-impregnated nonwoven fabric. The nonwoven fabric may be a fiber nonwoven fabric including one selected from the group consisting of polyester fibers, polyamide fibers, polypropylene fibers, polyethylene fibers, and combinations thereof.

The resin impregnated into the nonwoven fabric may include one selected from the group consisting of polyurethane resin, polybutadiene resin, styrene-butadiene copolymer resin, styrene-butadiene-styrene copolymer resin, acrylonitrile-butadiene copolymer resin, styrene-ethylene-butadiene-styrene copolymer resin, silicone rubber resin, polyester-based elastomer resin, polyamide-based elastomer resin, and combinations thereof.

Hereinafter, a method for producing the polishing pad will be described.

In another embodiment of the present disclosure, there may be provided a method for producing a polishing pad, the method including steps of: preparing a prepolymer composition; preparing a composition for producing a polishing layer containing the prepolymer composition, a foaming agent and a curing agent; and producing a polishing layer by curing the composition for producing a polishing layer.

The step of preparing the prepolymer composition may be a process of producing a urethane-based prepolymer by reacting a diisocyanate compound with a polyol compound. Details regarding the diisocyanate compound and the polyol compound are as described above with respect to the polishing pad.

The isocyanate group content (NCO %) of the prepolymer composition may be about 5 wt % to about 15 wt %, for example, about 5 wt % to about 8 wt %, for example, about 5 wt % to about 7 wt %, for example, about 8 wt % to about 15 wt %, for example, about 8 wt % to about 14 wt %, for example, about 8 wt % to about 12 wt %, for example, about 8 wt % to about 10 wt %.

The isocyanate group content of the prepolymer composition may be derived from the terminal isocyanate groups of the urethane-based prepolymer, the unreacted unreacted isocyanate groups in the diisocyanate compound, and the like.

The viscosity of the prepolymer composition may be about 100 cps to about 1,000 cps, for example, about 200 cps to about 800 cps, for example, about 200 cps to about 600 cps, for example, about 200 cps to about 550 cps, for example, about 300 cps to about 500 cps, at about 80° C.

The foaming agent may include a solid foaming agent or a gaseous foaming agent.

When the foaming agent includes a solid foaming agent, the step of preparing the composition for producing a polishing layer may include steps of: preparing a first preliminary composition by mixing the prepolymer composition and the solid foaming agent; and preparing a second preliminary composition by mixing the first preliminary composition and a curing agent.

The viscosity of the first preliminary composition may be about 1,000 cps to about 2,000 cps, for example, about 1,000 cps to about 1,800 cps, for example, about 1,000 cps to about 1,600 cps, for example, about 1,000 cps to about 1,500 cps, at about 80° C.

When the foaming agent includes a gaseous foaming agent, the step of preparing the composition for producing a polishing layer may include steps of: preparing a third preliminary composition containing the prepolymer composition and the curing agent; and preparing a fourth preliminary composition by injecting the gaseous foaming agent into the third preliminary composition.

In one embodiment, the third preliminary composition may further contain a solid foaming agent.

In one embodiment, the process of producing a polishing layer may include steps of: preparing a mold preheated to a first temperature; injecting and curing the composition for producing a polishing layer into and in the preheated mold; and post-curing the cured composition at a second temperature higher than the preheating temperature.

In one embodiment, the first temperature may be about 60° C. to about 120° C., for example, about 60° C. to about 100° C., for example, about 60° C. to about 80° C.

In one embodiment, the second temperature may be about 100° C. to about 130° C., for example, about 100° C. to 125° C., for example, about 100° C. to about 120° C.

The step of curing the composition for producing a polishing layer at the first temperature may be performed for about 5 minutes to about 60 minutes, for example, about 5 minutes to about 40 minutes, for example, about 5 minutes to about 30 minutes, for example, about 5 minutes to about 25 minutes.

The step of post-curing the composition (cured at the first temperature) at the second temperature may be performed for about 5 hours to about 30 hours, for example, about 5 hours to about 25 hours, for example, about 10 hours to about 30 hours, for example, about 10 hours to about 25 hours, for example, about 12 hours to about 24 hours, for example, about 15 hours to about 24 hours.

The method of producing a polishing pad may include a step of processing at least one surface of the polishing layer. The processing step may include forming grooves.

In another embodiment, the step of processing at least one surface of the polishing layer may include at least one of steps of: (1) forming grooves on at least one surface of the polishing layer; (2) line-turning at least one surface of the polishing layer; and (3) roughening at least one surface of the polishing layer.

In step (1), the grooves may include at least one of concentric grooves arranged from the center of the polishing layer so as to be spaced apart from each other at a predetermined distance, and radial grooves continuously extending from the center of the polishing layer to the edge of the polishing layer.

In step (2), the line turning may be performed by a method of cutting the polishing layer by a predetermined thickness by means of a cutting tool.

The roughening in step (3) may be performed by a method of processing the surface of the polishing layer with sanding rollers.

The method of producing a polishing pad may further include a step of laminating a cushion layer on a surface opposite to the polishing surface of the polishing layer.

The polishing layer and the cushion layer may be laminated together through a heat-sealing adhesive.

The heat-sealing adhesive may be applied onto a surface opposite to the polishing surface of the polishing layer, and the heat-sealing adhesive may be applied onto the surface to be in contact with the polishing layer of the cushion layer. The polishing layer and the cushion layer may be laminated together in such a manner that the surfaces to which the heat-sealing adhesive has been applied come into contact with each other, and then the two layers may be laminated together using a pressure roller.

In another embodiment of the present disclosure, the method includes: providing a polishing pad including a polishing layer; and polishing a polishing target while allowing the polishing target and the polishing layer to rotate relative to each other so that the polishing-target surface of the polishing target is in contact with the polishing surface of the polishing layer.

FIG. 1 is a schematic view showing a process for fabricating a semiconductor device according to an embodiment. Referring to FIG. 1, a polishing pad 110 according to the embodiment is mounted on a surface plate 120, and then a semiconductor substrate 130 as a polishing target is disposed on the polishing pad 110. At this time, the polishing target surface of the semiconductor substrate 130 is in direct contact with the polishing surface of the polishing pad 110. For polishing, a polishing slurry 150 may be sprayed onto the polishing pad through a nozzle 140. The flow rate of the abrasive slurry 150 that is sprayed through the nozzle 140 may be selected within the range of about 10 $cm^3$/min to about 1,000 $cm^3$/min, for example, about 50 $cm^3$/min to about 500 $cm^3$/min, depending on the purpose, but is not limited thereto.

Next, the semiconductor substrate 130 and the polishing pad 110 may be rotated relative to each other, so that the surface of the semiconductor substrate 130 may be polished. In this case, the rotating direction of the semiconductor substrate 130 and the rotating direction of the polishing pad 110 may be the same direction or may be opposite to each other. The rotating speed of each of the semiconductor substrate 130 and the polishing pad 110 may be selected within the range of about 10 rpm to about 500 rpm depending on the purpose, and may be, for example, about 30 rpm to about 200 rpm, but is not limited thereto.

The semiconductor substrate 130 may be pressed against the polishing surface of the polishing pad 110 under a predetermined load in a state of being mounted on the polishing head 160 so that it is in contact with the polishing surface of the polishing pad 110, and then the surface thereof may be polished. The load under which the surface of the semiconductor substrate 130 is pressed against the polishing surface of the polishing pad 110 by the polishing head 160 may be selected within the range of about 1 gf/$cm^2$ to about 1,000 gf/$cm^2$ depending on the purpose, and may be for example, about 10 gf/$cm^2$ to about 800 gf/$cm^2$, but is not limited thereto.

In one embodiment, the method for fabricating a semiconductor device may further include a step of processing the polishing surface of the polishing pad 110 by a conditioner 170 at the same time as polishing of the semiconductor substrate 130 in order to maintain the polishing surface of the polishing pad 110 in a state suitable for polishing.

Hereinafter, specific examples of the present disclosure will be presented. However, the examples described below serve merely to illustrate or explain the present disclosure in detail, and the scope of the present disclosure should not be limited thereto.

Example 1

Production of Polishing Pad

In a casting system including lines for introducing a mixture of a urethane-based prepolymer, a curing agent and a solid foaming agent, a urethane-based prepolymer having an unreacted NCO content of 9 wt % was introduced into a prepolymer tank, and bis(4-amino-3-chlorophenyl)methane (Ishihara Corp.) was introduced into a curing agent tank. In addition, 100 parts by weight of the urethane-based prepolymer was premixed with 3 parts by weight of the solid foaming agent and then introduced into the prepolymer tank.

The urethane-based prepolymer and the curing agent were stirred while they were introduced through the respective input lines into a mixing head at constant rates. At this time, the molar equivalent of the NCO group of the urethane prepolymer and the molar equivalent of the reactive group of the curing agent were adjusted to 1:1, and the total input rate was maintained at a rate of 10 kg/min.

The stirred raw materials were injected into a preheated mold and prepared into a single porous polyurethane sheet. Thereafter, the surface of the prepared porous polyurethane sheet was ground using a grinding machine, and grooved using a tip, thus producing a sheet having an average thickness of 2 mm and an average diameter of 76.2 cm.

The polyurethane sheet and suede (base layer, average thickness: 1.1 mm) were heat-bonded together using a hot melt film (manufacturer: SKC, product name: TF-00) at 120° C., thus producing a polishing pad.

A urethane-based prepolymer having an NCO functional group at the end was produced as follows. Based on 100 parts by weight of the total weight of diisocyanate components, 90 parts by weight of toluene diisocyanate and 10 parts by weight of dicyclohexylmethane diisocyanate were mixed together. Based on 100 parts by weight of the total weight of polyol components, 90 parts by weight of PTMEG (molecular weight (MW): 1,000) and 10 parts by weight of DEG were mixed together. A raw material mixture was prepared by mixing 152 parts by weight of the mixture of the polyol components with 100 parts by weight of the mixture of the diisocyanate components. A preliminary composition having a urethane group was prepared by placing the raw material mixture in a four-neck flask and then allowing the mixture to react at 80° C. The content of isocyanate groups (NCO groups) in the prepared preliminary composition was 8.8 to 9.4%.

Examples 2 to 4 and Comparative Examples 1 to 4 were prepared in the same manner as in Example 1, except that the preheating temperature of the molding was changed or the content of the curing agent was changed.

TABLE 11

| | Example 1 | Example 2 | Example 3 | Example 4 | Comp. Example 1 | Comp. Example 2 | Comp. Example 3 | Comp. Example 4 |
|---|---|---|---|---|---|---|---|---|
| Prepolymer | Terminal NCO content: 8.8 to 9.4% | | | | | | | |
| Curing agent (parts by weight) | 25 | 25 | 25 | 25 | 25 | 25 | 23 | 25 |
| Mold preheating temperature (° C.) | 65 | 60 | 70 | 80 | 50 | 90 | 50 | 130 |

(The content of the curing agent is based on 100 parts by weight of the urethane-based prepolymer)

Test Example 1

Measurement of Physical Properties of Polishing Pads and Removal Rates (1) Hardness 1) The Shore D hardness of each of the polishing pads produced in the Examples and the Comparative Examples was measured. Specifically, each polishing pad was cut to a size of 2 cm×2 cm (thickness: 2 mm), and then left to stand for 16 hours in an environment with a temperature of 25° C. and a humidity of 50±5%. Next, the hardness of each polishing pad was measured at five points using a Digital Shore Hardness Tester HPE III (D-type hardness meter) for 30 seconds.

(2) Elastic Modulus

For each of the polishing pads produced in the Examples and the Comparative Examples, the peak strength value immediately before breakage was obtained while testing was performed using a universal testing machine (UTM, AG-X Plus (SHIMADZU)) and an extensometer at a grip distance of 60 mm and a speed of 500 mm/min. Based on the obtained value, the slope in the region corresponding to 20 to 70% of the strain-stress curve was calculated.

(3) Elongation

For each of the polishing pads produced in the Examples and the Comparative Examples, the maximum deformation immediately before breakage was measured while testing was performed using a universal testing machine (UTM, AG-X Plus (SHIMADZU)) and an extensometer at a grip distance of 60 mm and a speed of 500 mm/min. The ratio of the maximum deformation to the initial length was expressed as a percentage (%).

(4) Measurement of Removal Rates

<Removal Rate of Oxide (O) Layer>

On a CMP device, a 300-mm-diameter silicon wafer having a silicon oxide (SiOx) layer formed thereon by a TEOS-plasma CVD process was placed. Thereafter, the silicon oxide film of the silicon wafer was set down on the surface plate to which the polishing pad was attached. Next, the polishing load was adjusted to 1.4 psi, and the silicon oxide layer was polished by rotating the surface plate at 115 rpm for 60 seconds while introducing an abrasive slurry (ceria slurry) onto the polishing pad at a rate of 190 ml/min. After polishing, the silicon wafer was removed from the carrier, mounted in a spin dryer, washed with purified water (DIW), and then dried with air for 15 seconds. For the dried silicon wafer, the difference in thickness between before and after polishing was measured using an optical interference thickness measurement device (manufacturer: Kyence Corporation, model name: SI-F80R). Then, the removal rate was calculated using Mathematical Equation 1 below.

<Removal Rate of Silicon Nitride (SiN) Layer>

On a CMP device, a 300-mm-diameter silicon wafer having a SiN layer formed thereon by a CVD process was placed. Thereafter, the SiN layer of the silicon wafer was set down on the surface plate to which the polishing pad was attached. Next, the polishing load was adjusted to 1.4 psi, and the SiN layer was polished by rotating the surface plate at 115 rpm for 60 seconds while introducing an abrasive slurry (ceria slurry) onto the polishing pad at a rate of 190 ml/min. After polishing, the silicon wafer was removed from the carrier, mounted in a spin dryer, washed with purified water (DIW), and then dried with air for 15 seconds. For the dried silicon wafer, the difference in thickness between before and after polishing was measured using an optical interference thickness measurement device (manufacturer: Kyence Corporation, model name: SI-F80R). Then, the removal rate was calculated using Mathematical Equation 1 below.

Removal rate (Å/min)=Thickness difference (Å) between before and after polishing/polishing time (min) <Mathematical Equation 1>

The physical properties of the polishing pads of the Examples and the Comparative Examples and the removal rates were measured by the above-described physical property measurement methods, and the results of the measurement are shown in Table 2 below.

TABLE 2

| | Example 1 | Example 2 | Example 3 | Example 4 | Comparative Example 1 | Comparative Example 2 |
|---|---|---|---|---|---|---|
| Hardness (shore D) | 57.7 | 56.2 | 56.9 | 57.5 | 55.5 | 58.5 |
| Modulus ($N/mm^2$) | 110.3 | 123.1 | 135.2 | 121.1 | 60.6 | 111 |
| Elongation (%) | 80.3 | 80.1 | 81.1 | 81.9 | 58.6 | 142.9 |
| TEOS (oxide) removal rate (Å/min) | 2210 | 2195 | 2384 | 2135 | 1999 | 2088 |
| Nitride removal rate (Å/min) | 67.7 | 76.1 | 65.3 | 48.5 | 96 | 67.2 |
| Oxide removal rate/nitride removal rate | 32.9 | 32.4 | 31.3 | 32.7 | 41.2 | 21.8 |
| Equation 1 ((0.1H + 0.3M + 0.6E)/100) | 0.870 | 0.906 | 0.949 | 0.912 | 0.589 | 1.249 |
| Equation 2 ((0.1H + 0.2M + 0.7E)/100) | 0.840 | 0.863 | 0.895 | 0.873 | 0.587 | 1.281 |

Referring to the values shown in Table 2 above, the polishing pads of Examples 1 to 4 showed some differences in hardness, modulus and elongation from the Comparative Examples. In particular, as a result of calculating the physical property values by the Equations regarding the relationship between the physical properties of the polishing pad, the physical property values calculated by Equation 1 were 0.870 for Example 1, 0.906 for Example 2, 0.949 for Example 3, and 0.912 for Example 4, which were included within the range specified in the present disclosure. However, the physical property values calculated by Equation 1 were 0.589 for Comparative Example 1 and 1.249 for Comparative Example 2, which were not included within the range specified in the present disclosure.

In addition, the physical property values calculated by Equation 2 were 0.840 for Example 1, 0.863 for Example 2, 0.895 for Example 3, and 0.873 for Example 4, which were included within the range specified in the present disclosure. However, the physical property values calculated by Equation 2 were 0.587 for Comparative Example 1 and 1.281 for Comparative Example 2, which were not included within the range specified in the present disclosure.

As a result of measuring the removal rates of the oxide layer and the nitride layer together with the values calculated by Equations 1 and 2, the polishing pads of Examples 1 to 4 showed a high removal rate for the oxide layer and a low removal rate for the nitride layer which is a stop layer, and showed an oxide to nitride removal rate selectivity of about 31 to 33. However, it was confirmed that the polishing pads of Comparative Examples 1 and 2 showed a lower removal rate for the oxide layer than the Examples, and a nitride layer removal rate which is higher than or similar to those of the Examples, and showed an oxide to nitride removal rate selectivity of about 21.8 or about 41.2.

Test Example 2

Measurement of Dishing

On a CMP device, a 300-mm-diameter silicon wafer which is a patterned wafer (SKW 3-1, pattern density: 50%) shown in FIG. 2 was placed. Thereafter, the high-density plasma (HDP) layer of the silicon wafer was set down on the surface plate to which the polishing pad was attached. Next, the polishing load was adjusted to 4.0 psi, and the HDP layer was polished by rotating the surface plate at 87 rpm for 60 seconds while introducing an abrasive slurry (ceria slurry) onto the polishing pad at a rate of 300 ml/min. After polishing, the silicon wafer was removed from the carrier, mounted in a spin dryer, washed with purified water (DIW), and then dried with air for 15 seconds. For the dried silicon wafer, the difference in thickness between before and after polishing was measured using an optical interference thickness measurement device (manufacturer: Kyence Corporation, model name: SI-F80R).

After this polishing, the height of the silicon oxide layer was 1,200 to 1,400 Å, and the height of the silicon nitride film was 1,000 Å, suggesting that the initial step height was removed. Next, the same polishing process was additionally performed for 40 seconds (overpolishing), and then the degree of dishing was measured.

The dishing (A) is a measure of the distance from the uppermost portion of the silicon nitride layer to the uppermost portion of the silicon oxide layer.

After the physical properties of the polishing pads of the Examples and the Comparative Examples were measured by the above-described physical property measurement methods and the polishing process using each of the polishing pads was performed, dishing was measured, and the results of the measurement are shown in Table 3 below.

For calculation by Equations 3 and 4, Comparative Example 3 had a hardness of (shore D) of 56, a modulus ($N/mm^2$) of 102.1, and an elongation (%) of 80.3, and Comparative Example 4 had a hardness (shore D) of 56.2, a modulus ($N/mm^2$) of 182.7, and an elongation (%) of 66.3.

TABLE 3

| | Example 1 | Example 2 | Example 3 | Example 4 | Comparative Example 3 | Comparative Example 4 |
|---|---|---|---|---|---|---|
| Dishing (Å) | 15 | 31 | 24 | −4 | 227 | 105 |
| Equation 3 ((0.8M + 0.2E)/100) | 1.043 | 1.145 | 1.244 | 1.133 | 0.977 | 1.594 |

TABLE 3-continued

| | Example 1 | Example 2 | Example 3 | Example 4 | Comparative Example 3 | Comparative Example 4 |
|---|---|---|---|---|---|---|
| Equation 4 ((0.9M + 0.1H)/100) | 1.050 | 1.164 | 1.274 | 1.147 | 0.975 | 1.701 |

Referring to Table 3 above, as a result of calculating Equation 3 using the hardness, modulus and elongation measured as described above, the values obtained by calculating Equation 3 were 1.043 for Example 1, 1.145 for Example 2, 1.244 for Example 3, and 1.133 for Example 4, which were included within the range specified in the present disclosure. However, the values were 0.977 for Comparative Example 3 and 1.594 for Comparative Example 4, which were out of the range specified in the present disclosure.

Likewise, the values obtained by calculating Equation 4 were 1.050 for Example 1, 1.164 for Example 2, 1.274 for Example 3, and 1.147 for Example 4, which were included within the range specified in the present disclosure. However, the values for Comparative Examples 3 and 4 were not included within the range specified in the present disclosure.

As a result of analyzing the degree of dishing based on the results obtained by calculating Equations 3 and 4, Examples 1 to 4 of the present disclosure showed dishing values of 15 Å, 31 Å, 24 Å and −4 Å, respectively, which are insignificant, suggesting that they had an excellent effect of suppressing defects. However, Comparative Examples 3 and 4 showed dishing values of 227 Å and 105 Å, respectively, which greatly differ from those of the Examples.

It was confirmed that the Examples of the present disclosure showed a value within the specified range, and thus it was possible to control the removal rates.

Although preferred embodiments of the present disclosure have been described in detail above, the scope of the present disclosure is not limited thereto, and various modifications and improvements made by those skilled in the art without departing from the basic concept of the present disclosure as defined by the appended claims also fall within the scope of the present disclosure.

What is claimed is:

1. A polishing pad comprising a polishing layer having a value of 0.6 to 1 as calculated by the following Equation 1, wherein the polishing layer has a value of 0.6 to 1 as calculated by the following Equation 2, wherein the polishing layer comprises a cured product of a composition for producing a polishing layer containing a urethane-based prepolymer and a curing agent, and wherein the curing agent is contained in an amount of 21 to 27 parts by weight based on 100 parts by weight of the urethane-based prepolymer:

$$\frac{0.1H + 0.3M + 0.6E}{100} \quad \text{[Equation 1]}$$

$$\frac{0.1H + 0.2M + 0.7E}{100} \quad \text{[Equation 2]}$$

wherein:

H is a surface hardness (shore D) of a polishing surface of the polishing layer;

M is an elastic modulus ($N/mm^2$) of the polishing layer; and

E is an elongation (%) of the polishing layer.

2. The polishing pad of claim 1, wherein the polishing layer has a value of 1 to 1.7 as calculated by the following Equation 3:

$$\frac{0.8M + 0.2E}{100} \quad \text{[Equation 3]}$$

wherein M and E are as defined in claim 1.

3. The polishing pad of claim 1, wherein the polishing layer has a value of 1 to 1.7 as calculated by the following Equation 4:

$$\frac{0.9M + 0.1H}{100} \quad \text{[Equation 4]}$$

wherein

M is as defined in claim 1, and

H is a surface hardness (shore D) of a polishing surface of the polishing layer.

4. The polishing pad of claim 1, which has an oxide removal rate of 1,500 to 2,500 Å/min.

5. The polishing pad of claim 1, which has a nitride removal rate of 35 to 100 Å/min.

6. The polishing pad of claim 1, which has an oxide to nitride removal rate selectivity (Ox RR/Nt RR) of 25 to 40.

7. The polishing pad of claim 1, wherein the polishing surface of the polishing layer has a surface hardness (shore D) of 45 to 65 at 25° C.

8. The polishing pad of claim 1, wherein the polishing layer has an elastic modulus of 70 to 200 $N/mm^2$.

9. The polishing pad of claim 1, wherein the polishing layer has an elongation of 60 to 140%.

10. The polishing pad of claim 1, wherein the polishing pad has an absolute value of dishing of 1 to 100 Å, which is a measure of the degree to which a target layer deviates from flatness by a polishing process.

* * * * *